US007702269B2

(12) United States Patent
Maekawa

(10) Patent No.: US 7,702,269 B2
(45) Date of Patent: Apr. 20, 2010

(54) ENDLESS BELT FOR IMAGE FORMING APPARATUS AND IMAGE FORMING APPARATUS HAVING THE ENDLESS BELT

(75) Inventor: Ichiro Maekawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 777 days.

(21) Appl. No.: 11/562,167

(22) Filed: Nov. 21, 2006

(65) Prior Publication Data

US 2007/0122211 A1 May 31, 2007

(30) Foreign Application Priority Data

Nov. 30, 2005 (JP) ..... 2005-346690

(51) Int. Cl.
*G03G 15/20* (2006.01)

(52) U.S. Cl. ..... 399/308

(58) Field of Classification Search ..... 399/302, 399/308, 312, 313, 303
See application file for complete search history.

(56) References Cited

U.S. PATENT DOCUMENTS

| | | | | |
|---|---|---|---|---|
| 5,944,930 | A | 8/1999 | Takeuchi et al. | 156/218 |
| 6,094,558 | A | 7/2000 | Shimizu et al. | 399/303 |
| 6,132,828 | A | 10/2000 | Yasui et al. | 428/36.91 |
| 6,962,637 | B2 | 11/2005 | Takeuchi et al. | 156/85 |
| 7,251,420 | B2 * | 7/2007 | Fujimori et al. | 399/27 |
| 7,462,389 | B2 * | 12/2008 | Egawa | 428/328 |

FOREIGN PATENT DOCUMENTS

| | | |
|---|---|---|
| JP | 7-205274 | 8/1995 |
| JP | 8-187773 | 7/1996 |
| JP | 11-024428 | 1/1999 |
| JP | 11-161036 | 6/1999 |

* cited by examiner

*Primary Examiner*—David M Gray
*Assistant Examiner*—Gregory H Curran
(74) *Attorney, Agent, or Firm*—Fitzpatrick, Cella, Harper & Scinto

(57) ABSTRACT

The present invention provides an endless belt for an image forming apparatus having at least two layers of an inner layer and an outermost layer, in which the average regular reflectance of the surface of the outermost layer is 5.0% or more and the fluctuation of the regular reflectance of the surface of the outermost layer is kept within ±10%, and an image forming apparatus having the endless belt for an image forming apparatus.

6 Claims, 2 Drawing Sheets

ENDLESS BELT FOR IMAGE FORMING APPARATUS AND IMAGE FORMING APPARATUS HAVING THE ENDLESS BELT

BACKGROUND OF THE INVENTION

1. Field of the Invention

The present invention relates to an endless belt for an image forming apparatus and the image forming apparatus having the endless belt. Particularly, the present invention relates to an intermediate transfer belt used for an image forming apparatus such as a copying machine, laser beam printer or facsimile, endless belt such as a transfer material carrying belt and image forming apparatus having the endless belt.

2. Description of the Related Art

First, a case of using an endless belt for an image forming apparatus as a transfer material carrying belt is described below.

FIG. 1 is an illustration showing a schematic configuration of an image forming apparatus (color image forming apparatus) having a transfer material carrying belt.

The color image forming apparatus having the configuration shown in FIG. 1 is provided with four drum-shaped photosensitive members (photosensitive drums) (photosensitive drums 1*a*, 1*b*, 1*c* and 1*d*) serving as image bearing members.

Moreover, charging means (charging units 2*a*, 2*b*, 2*c* and 2*d*) for uniformly charging the surfaces of the photosensitive drums, exposing means (laser scanners 3*a*, 3*b*, 3*c* and 3*d*) for irradiating the surfaces of the photosensitive members with laser beams the photosensitive drums in accordance with image information and forming an electrostatic latent image on surfaces of the photoconductor drums, developing means (development units 4*a*, 4*b*, 4*c* and 4*d*) for attaching toner to the electrostatic latent image and visualizing the image as a toner image, transfer means (transfer rollers 5*a*, 5*b*, 5*c* and 5*d*) for transferring the toner image to a transfer material (paper or OHP film) S and cleaning means (cleaners 6*a*, 6*b*, 6*c* and 6*d*) for removing transfer-residual toner left on surfaces of the photosensitive drums after transfer are arranged around the photosensitive drums 1*a*, 1*b*, 1*c* and 1*d*, in that order in the rotational direction (counterclockwise rotation in FIG. 1) of the photoconductor drums to constitute image forming portions of respective colors.

Furthermore, the photosensitive drums 1*a*, 1*b*, 1*c* and 1*d*, charging units 2*a*, 2*b*, 2*c* and 2*d*, development units 4*a*, 4*b*, 4*c* and 4*d*, and cleaners 6*a*, 6*b*, 6*c* and 6*d* are integrally formed into cartridges as shown in FIG. 1 to constitute process cartridges (process cartridges 7*a*, 7*b*, 7*c* and 7*d*).

The transfer material S is carried sequentially to the image forming portions of respective colors by a transfer material carrying belt 9, toner images of respective colors are transferred and sequentially superimposed, and a synthetic toner image is formed. Then, the synthetic toner image is fixed by fixing means (fixing unit 10) and discharged to the outside of the apparatus.

Next, a case of using an endless belt for an image forming apparatus as an intermediate transfer belt is described below.

FIG. 2 is an illustration showing a schematic configuration of an image forming apparatus (color image forming apparatus) having an intermediate transfer belt.

A color image forming apparatus having the configuration shown in FIG. 2 is provided with four drum-shaped photosensitive members (photosensitive drums) (photosensitive drums 1*a*, 1*b*, 1*c* and 1*d*) serving as image bearing members.

Moreover, charging means (charging units 2*a*, 2*b*, 2*c* and 2*d*) for uniformly charging the surfaces of the photosensitive drums, exposing means (laser scanners 3*a*, 3*b*, 3*c* and 3*d*) for irradiating the surfaces of the photosensitive drums with laser beams in accordance with image information and forming an electrostatic latent image on the surfaces of the photosensitive drums, developing means (development units 4*a*, 4*b*, 4*c* and 4*d*) for attaching toner to the electrostatic latent image and visualizing the image as a toner image, primary transferring means (primary transfer rollers 5*pa*, 5*pb*, 5*pc* and 5*pd*) for primarily transferring the toner image to an intermediate transfer belt 11 and cleaning means (cleaners 6*a*, 6*b*, 6*c* and 6*d*) for removing transfer-residual toner left on surfaces of the photosensitive drums after primary transfer are arranged around the photosensitive drums 1*a*, 1*b*, 1*c* and 1*d* in that order in accordance with the rotational direction (counterclockwise rotation in FIG. 2) of the photoconductor drums to constitute image forming portions of various colors.

Furthermore, the photoconductor drums 1*a*, 1*b*, 1*c* and 1*d*, charging units 2*a*, 2*b*, 2*c* and 2*d*, development units 4*a*, 4*b*, 4*c* and 4*d*, and cleaners 6*a*, 6*b*, 6*c* and 6*d* are integrally formed into cartridges as shown in FIG. 1 to constitute process cartridges (process cartridges 7*a*, 7*b*, 7*c* and 7*d*).

Toner images of respective colors are transferred and sequentially superimposed on the intermediate transfer belt 11 and a synthetic toner image is formed in the image forming portions of respective colors.

The transfer material S is carried to a portion between the intermediate transfer belt 11 and secondary transfer means (secondary transfer roller 5*s*) and a synthetic toner image is transferred and fixed by fixing means (fixing unit 10) and discharged to the outside of the apparatus.

As described above, the color image forming apparatus forms a color image (full color image) by superimposing images of four colors in total from first color to fourth color (generally, yellow, magenta, cyan and black) on a transfer material or intermediate transfer belt. Therefore, when writing start positions of four colors in the sub-scanning direction (moving direction of the transfer material or intermediate transfer belt) do not coincide with each other, a problem in images referred to as a color shift occurs. Moreover, as other factors for creating a color shift, there are a shift of writing start position in the main scanning direction (a direction vertical to the moving direction of a transfer material or an intermediate transfer belt) and a color shift due to the fluctuation of the primary scanning line width.

In order to rectifying the color shift in the sub-scanning direction or main scanning direction, it has been known to form a pattern for detecting a color shift on the transfer material carrying belt or intermediate transfer belt for each color, detect the pattern by a pair of optical sensors set on both sides of the downstream portion of the transfer material carrying belt or the downstream portion of the intermediate transfer belt and perform various adjustments such as exposure timing adjustment of an image forming portion and speed adjustment of a plurality of photoconductor drums, transfer material carrying belt or intermediate transfer belt.

FIG. 3 is an illustration for explaining color shift detecting means. Though the case of a transfer material carrying belt is used as an example, the same may be applied to the case of an intermediate transfer belt.

In FIG. 3, reference numeral 20 denotes a color shift detecting means which is constituted of a light emitting element and a light receiving element. Reference numeral 21 denotes a light emitting element which is an LED for emitting, for example, light with a wavelength of an infrared region. Reference numeral 22 denotes a light receiving element (such as a photosensor). Reference numeral 9 denotes a transfer material carrying belt and 23 denotes a pattern for detecting a color shift. Reference numeral 24 denotes a light emitting optical path extended from the light emitting element 21, and 25 denotes a light receiving optical path through which reflected light from the transfer material carrying belt 9 or color shift detecting pattern 23 is received by the light receiving element 22. A light emitting portion and light receiving portion are constituted of a regular reflection optical system using the transfer material carrying belt 9 as a reflection plane to detect the position of a color shift detecting pattern in accordance with the difference between reflectances of regularly reflected lights of the transfer material carrying belt 9 and color shift detecting pattern 23, i.e., the difference between regular reflectances.

Therefore, in the case of an endless belt used for an image forming apparatus, it is necessary that the regular reflectance of the surface is high in order to increase a difference in regular reflectance with reference to toner, and moreover it is necessary that abrasion resistance is high in order to minimize a lowering in the regular reflectance of the surface due to long time use.

From such a point of view, as an endless belt for an image forming apparatus, an endless belt made of polyimide and endless belt of a multilayer configuration using a hard coat material for the outermost layer has been proposed (see Japanese Patent Application Laid-Open Nos. H11-161036 and H11-024428).

However, when using polyimide for an endless belt, cost is liable to be raised because the reaction process is long. Moreover, the surface hardness is as low as the maximum pencil hardness of 2H. Therefore, when using the endless belt for a long time, the surface is shaved by a photosensitive member, roller and transfer material, irregularity occurs and the regular reflectance of the surface of the endless belt is lowered. When the regular reflectance of the endless belt is lowered, a difference in regular reflectance with reference to toner is reduced and thereby sufficient color-shift detecting performance cannot be obtained.

Moreover, some conventional endless belts of a multilayer configuration using a hard coat material for the outermost layer use fluorocarbon resin for the outermost layer in order to improve the releasability of toner. However, because the fluorocarbon resin is a low-refraction-index material, when detecting a color shift by using regular reflection on the surface of the endless belt, the difference between regular reflectances of toner and the surface is reduced. Therefore, an error factor such as noise is increased and it is difficult to exhibit stable color-shift detecting performance.

Furthermore, when using a conventional endless belt of a multilayer configuration, the color shift detecting performance may be particularly lowered. This is because the incident light of a color shift detecting sensor passes through the outermost layer of the endless belt of a multilayer configuration and reflects on the interface between the outermost layer and the inner layer, and the reflected light on the outer surface of the outermost layer interferes with the reflected light from the interface between the outermost layer and the inner layer. Particularly, when the thickness of the outermost layer is fluctuated around integral multiples of ¼ of the wavelength of the incident light of the color shift detecting sensor, the incident light entering the photosensor of the color shift detecting sensor is greatly fluctuated and the color shift detecting performance is lowered.

SUMMARY OF THE INVENTION

An object of the present invention is to provide an endless belt for an image forming apparatus having a high color shift detecting performance over a long period of time from the initial stage and an image forming apparatus having the endless belt for an image forming apparatus.

The present invention is an endless belt for an image forming apparatus having at least two layers of an inner layer and an outermost layer, in which the average regular reflectance of the surface of the outermost layer is 5.0% or more and the fluctuation of the regular reflectance of the surface of the outermost layer is kept within ±10% of the average regular reflectance.

Moreover, the present invention is an image forming apparatus having the endless belt for an image forming apparatus.

According to the present invention, it is possible to provide an endless belt for an image forming apparatus having a high color shift detecting performance over a long period of time from the initial stage and an image forming apparatus having the endless belt for an image forming apparatus.

Further features of the present invention will become apparent from the following description of exemplary embodiments with reference to the attached drawings.

DESCRIPTION OF THE EMBODIMENTS

The regular reflectance of a color shift detecting pattern constituted of toners of magenta, yellow, cyan and black is 2.5% or less. Therefore, when using the difference between regular reflectances of toner and the surface of an endless belt in detecting a color shift, in order to increase the difference between the regular reflectances, it is necessary that the average regular reflectance of the surface of the endless belt, i.e., the surface of the outermost layer of the endless belt, is 5.0% or more. When the regular reflectance of the surface of the outermost layer of the endless belt is less than 5.0%, it is difficult to precisely detect the position of a color shift detecting pattern by a color shift detecting sensor and the color shift detecting performance is lowered.

Moreover, it is necessary that the fluctuation of the regular reflectance of the surface of the outermost layer of an endless belt be kept within ±10% of the average regular reflectance. When the fluctuation of the regular reflectance is larger than ±10% of the average regular reflectance, because regular reflected light from the surface of the endless belt enters the sensor with a fluctuation larger than ±10%, an error may occur in detection of a color shift detecting pattern. When erroneous detection occurs, it is impossible to stably detect the color shift detecting pattern.

In this case, the "average regular reflectance" and "fluctuation of regular reflectance" are measured and defined as follows.

That is, the spectrophotometric measuring instrument made by Hitachi Ltd. (trade name: U4000) is used as a measuring instrument and an endless belt to be measured cut into a 20-mm square is used as a measurement sample. Then, the incident angle of light to the measurement sample is set to be 15° and the average value of regular reflectances in a wavelength region of 830 to 870 nm is defined as the regular reflectance at the measurement place. This measurement is performed at 30 places in the endless belt, and the average value of regular reflectances at the respective measurement places is defined as the average regular reflectance of the endless belt.

Furthermore, where the value of the average regular reflectance is x and the value farthest from the average regular reflectance among the regular reflectances at respective measurement places is y, $((y-x)/x)\times100(\%)$ is defined as the fluctuation of the regular reflectance of the endless belt.

Figure 4:
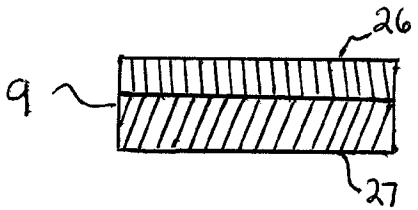
FIG. 4 is a schematic cross-sectional view of an endless belt of an image forming apparatus having multiple layers.

As shown in FIG. 4 endless belt 9 has two layers 26 and 27. By forming the endless belt into multilayer configuration (a configuration of two layers or more), it is possible to impart to layers the characteristics necessary for an endless belt for an image forming apparatus.

Because the function of the surface characteristic, particularly the function of abrasion resistance, is imparted to the outermost layer of the endless belt, it is preferable to use a high-hardness material such as hardening resin as a binding material. Moreover, in order to provide the inner layer of the endless belt with strength sufficient to be used as the endless belt, it is preferable to use thermoplastic resin or rubber which is inexpensive and has mechanical durability. Furthermore, it is preferable to bring the endless belt to the laminated type in which the inside of the inner layer is composed of a resin layer and the outside (outermost layer side) of the inner layer is composed of a rubber layer.

With respect to the abrasion resistance of the endless belt, it is preferable that the mass reduction rate after a Taber's abrasion test (ASTM-D-1175, load of 500 g and 500 rpm) is 0.10% or less. From another viewpoint, it is preferable that the pencil hardness is larger than 2H.

It is preferable that the outermost layer is a hard coat layer formed by the use of a hard coat material (organic material or inorganic material) capable of achieving the abrasion resistance, high hardness and high refractive index.

As the organic material, it is possible to use any one of melamine resin, urethane resin, alkyd resin and acrylic resin. As the inorganic material, it is possible to use any one of alkoxysilane, alkoxy zirconium and silicate. Among these substances, it is particularly preferable to use acrylic resin from the viewpoint of high hardness and coatability. The acrylic resin can be obtained by hardening acrylic monomer (for example, dipentaerythritol hexaacrylate) or prepolymer of acrylic resin.

Moreover, when the refractive index of the outermost layer is 1.60 or more, this is preferable because it is easy to achieve the average regular reflectance of 5.0% or more of the surface of the outermost layer. On the other hand, in the respect that it is easy to confirm a lowering in partial average regular reflectance due to a flaw, it is preferable that the refractive index of the outermost layer is 1.80 or less.

In order for the outermost layer to have a high refractive index, it is preferable to add fine particles having a high refractive index to the above hard coating material. As fine particles having a high refractive index, the following fine particles of metal oxide are used: tin oxide (refractive index of 2.0), phosphor-doped tin oxide (refractive index of 2.0), indium tin oxide (refractive index of 2.0), antimony tin oxide (refractive index of 2.1), zinc aluminum oxide (refractive index of 2.1), antimony pentoxide-zinc oxide (refractive index of 2.0), titanium oxide (refractive index of 2.4 to 2.7), cerium oxide (refractive index of 2.3), zinc oxide (refractive index of 2.1), zirconium oxide (refractive index of 2.1), antimony oxide (refractive index of 2.1) and indium oxide (refractive index of 2.0). Among the above, it is preferable to use titanium oxide capable of increasing the refractive index of the outermost layer by the addition of a small amount and antimony pentoxide-zinc oxide capable of providing the outermost layer with conductivity, as fine particles to be added to the outermost layer. It is preferable that amounts of these fine particles to be added are adjusted so that the refractive index of the outermost layer ranges from 1.60 to 1.80.

Moreover, in order to minimize diffusion reflection on the surface of the outermost layer, the diameters of fine particles to be added to the outermost layer are preferably 30 nm or less, and particularly 20 nm or less.

An element for emitting light having a wavelength in infrared region (830 to 870 nm) is frequently used as the light emitting element 21 of the color shift detecting means 20 used in an image forming apparatus. Therefore, to restrain the reflection on the interface between the outermost layer and the inner layer, it is preferable to add an infrared absorbent to the outermost layer. As the infrared absorbent to be added to the outermost layer, it is possible to properly select and use one of various infrared absorbents. For example, as the infrared absorbent, it is possible to use an organic compound including metal complex compounds such as nickel complex compound, nitroso compound and its metal complex salt, cyanine compound, squarilium compound, thiol nickel complex compound, naphthalocyanine compound, triarylmethane compound, imonium compound, diimonium compound, naphthoquine compound, anthraquinone compound, amino compound, aminium salt compound, metal sulfide and thiourea compound, phthalocyanine compound, fluorine-contained phthalocyanine compound, copper-compound bisthio-urea compound, phosphorous compound and copper compound, copper phosphate compound obtained through the reaction between phosphate ester compound and copper compound; and oxides, carbides or boride of a metal belonging to Group 4A, 5A or 6A group of the periodic table, such as tantalum oxide, niobium oxide, zirconium oxide and titanium dioxide; and inorganic compounds such as zinc oxide, indium oxide, tin oxide, zinc sulfide, indium tin oxide, antimony tin oxide, cerium oxide and carbon black. Among these substances, it is preferable to use an organic compound such as nickel complex, phosphorous compound, antimony compound and phthalocyanine compound. Specifically, the following products are used: YKR (trade name) series made by Yamamoto Chemicals, Inc., Kayasorb (trade name) series made by Nippon Kayaku Co., Ltd. and Excolor (trade name) series made by Nippon Shokubai Co., Ltd.

Moreover, it is preferable that the infrared transmittance of the outermost layer is 40% or less. When the infrared transmittance of the outermost layer is larger than 40%, infrared radiation is reflected on the interface between the outermost layer and the inner layer, and the reflected light on the surface of the outermost layer is apt to interfere with the reflected light on the interface between the outermost layer and the inner layer.

Moreover, it is preferable to use a material having an elastic modulus of 1 GPa or more as the material constituting the inner layer. Particularly, it is preferable to use thermoplastic resin which is inexpensive and easily available. As the thermoplastic resin, it is possible to use polyamide, polyacetal, polyarylate, polycarbonate, polyphenylene ether, polyethylene terephthalate, polysulfone, polyethersulfone, polyphenylene sulphide, polybutylene terephthalate, polyether ether-ketone, polyvinylidene fluoride, ethylene tetrafluoroethylene copolymer, tetrafluoroethylene-perfluoroalkyl vinylether copolymer, tetrafluoroethylene-hexafluoropropylene copolymer, polyvinyl fluoride, acrylic resin, alkyl acrylate copolymer, polyether ester copolymer, polyetheramide copolymer and polyurethane copolymer. Among these substances, it is preferable to use polycarbonate, polyethylene terephthalate, polybutylene terephthalate, polyvinylidene fluoride and ethylene tetrafluoroethylene copolymer. In the present invention, it is possible to use these thermoplastic resins singly or in a mixture of them.

Moreover, to provide elasticity for an endless belt for an image forming apparatus, it is possible to dispose a layer constituted of an elastomer as one of inner layers. As the elastomer, it is possible to use natural rubber, butadiene polymer, styrene-isoprene polymer, butadiene-styrene copolymer, hydrogenation product of them (including random copolymer, block copolymer and graft copolymer), isoprene polymer, chlorobutadiene polymer, butadiene-acrylonitrile copolymer, isobutylene polymer, isobutylene-butadiene copolymer, isobutylene-isoprene copolymer, acrylic ester polymer, ethylene-propylene copolymer, ethylene-propylene-diene copolymer, thiocol rubber, polysulfide rubber, polyurethane rubber, polyether rubber (such as polypropylene oxide) and epichlorohydrin rubber.

Moreover, to provide conductivity for the inner layer, it is possible to add a conductive material to the inner layer. It is preferable to use a substance which does not greatly change the properties of the thermoplastic resin as a conductive material to be added to the inner layer. As the conductive material, it is possible to use carbon inorganic conductive powder or fiber such as carbon black particle, carbon fiber and carbon nanotube.

Furthermore, it is possible to add one or more additives such as antioxidant, heat stabilizer, heat aging preventative, weather resistant agent, plasticizer, crystal nucleus agent, fluidity improvement agent, ultraviolet absorbent, lubricant, mold release agent, coloring agent such as dye and pigment, flame retardant and flame-retardant auxiliary agent.

Hereafter, the present invention is described in detail in accordance with examples.

First, methods of measuring and evaluating physical properties and characteristics are described below.

Refractive Index Measurement

Measuring instrument: Spectroscopic ellipsometer (Trade name: SpedEL-2000 made by Tokyo Instruments, Inc.)

Measurement Sample: A composition for the inner layer or the outermost layer was previously applied and placed onto a glass substrate and then a surface transfer process was carried out so that the face roughness Ra of a measurement face became 0.05 μm or less.

Measurement value: The average value in a wavelength region of 830 to 870 nm was defined as the refractive index.

Thickness Measurement (1) Measurement of Inner Layer Thickness

Measuring instrument: Linear gauge (Trade name: HS-3412 made by Ono Sokki Co., Ltd.)

Measurement Sample: An endless type tube was cut.

Measurement value: Thickness was measured in the cylindrical direction of a tube at pitches of 10 mm and the average value is defined as the thickness value.

Measurement was performed at 30 places on the inner layer of an endless belt and the average value is defined as the thickness of the inner layer.

(2) Measurement of Outermost Layer Thickness

Measuring instrument: Scanning electron microscope (Trade name S-3400 made by Hitachi High-Technologies Corporation)

Measurement sample: An endless belt on which the outermost layer was formed was cut in the sectional direction and set on a holder for observation.

Measurement value: The thickness of an outermost layer was measured through sectional observation of the endless belt.

Measurement was performed at 30 places on the outermost layer of the endless belt and the average value is defined as the thickness of the outermost layer.

Infrared Transmittance Measurement

Measuring instrument: Spectrophotometric measuring instrument (Trade name: U4000 made by Hitachi, Ltd.)

Measurement sample: A composition for forming an outermost layer was previously applied and placed onto a glass substrate and then a surface transfer process was carried out so that the face roughness Ra of a measurement face became 0.05 μm or less.

Measurement value: Average value in the wavelength region of 830 to 870 nm was defined as transmittance.

Example 1

Inner Layer

Polyvinylidene fluoride (Trade name: KF Polymer made by Kureha Chemical Industry Co., Ltd.) was used as the composition for forming an inner layer. To provide conductivity to the polyvinylidene fluoride, 8 mass % of acetylene black (Trade name: DENKA BLACK powder made by Denki Kagaku Kogyo K. K.) was added to polyvinylidene fluoride and 10 mass % of a compound containing alkyl quaternary ammonium sulfate ($(C_4H_9)_4NHSO_4$ made by Koei Chemical Co., Ltd.) was added to polyvinylidene fluoride. These substances were kneaded by using a kneading extruder having a twin screw under nitrogen gas atmosphere to obtain pellets of resin composition. The pellets were dried under nitrogen gas atmosphere.

Then, the pellets of resin composition were supplied to a cylindrical extruder to obtain a cylindrical endless tube having a thickness of 100 μm by fusion-extruding them.

The refractive index of the endless tube (inner layer) was 1.41.

Outermost Layer

Ultraviolet curing acrylic resin (Trade name: DESOLITE Z7501 made by JSR Inc.) was used as the composition for forming an outermost layer. To provide conductivity to the acrylic resin, 30 mass % of isopropyl alcohol sol of zinc antimonate (Trade name: CELNAX made by Nissan Chemical Industries, Ltd.) was added to the acrylic resin. 40 mass % of isopropyl alcohol and the acrylic resin, 10 mass % of methyl ethyl ketone were mixed and agitated with the acrylic resin. Moreover, 1.7 mass % of phthalocyanine compound (Trade name: YKR-2080 made by Yamamoto Chemicals, Inc.) was added to the acrylic resin to obtain the solution of composition for forming an outermost layer. This solution was applied to the outside of the endless tube of the above inner layer by the dip coat method and ultraviolet light was applied to the outside of the endless tube to obtain an outermost layer having a thickness of 0.9 to 1.1 μm.

The refractive index of the outermost layer was 1.60 and the infrared transmittance was 38%.

The average regular reflectance of the surface of the outermost layer of the endless belt of this example was 5.1% and the fluctuation of the regular reflectance was kept within ±9%.

Figure 1:
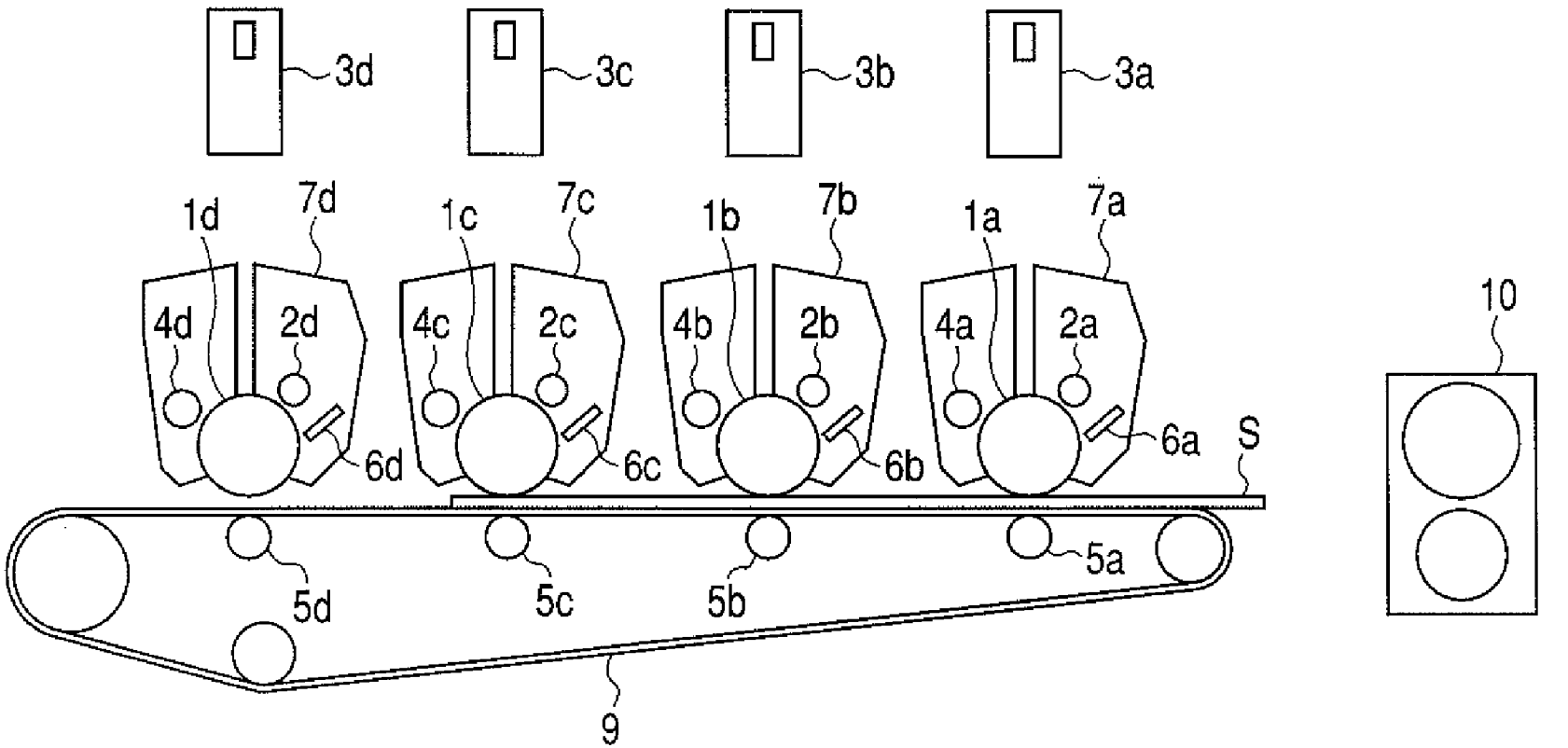
FIG. 1 is an illustration showing a schematic configuration of an image forming apparatus (color image forming apparatus) having a transfer material carrying belt.
Figure 2:
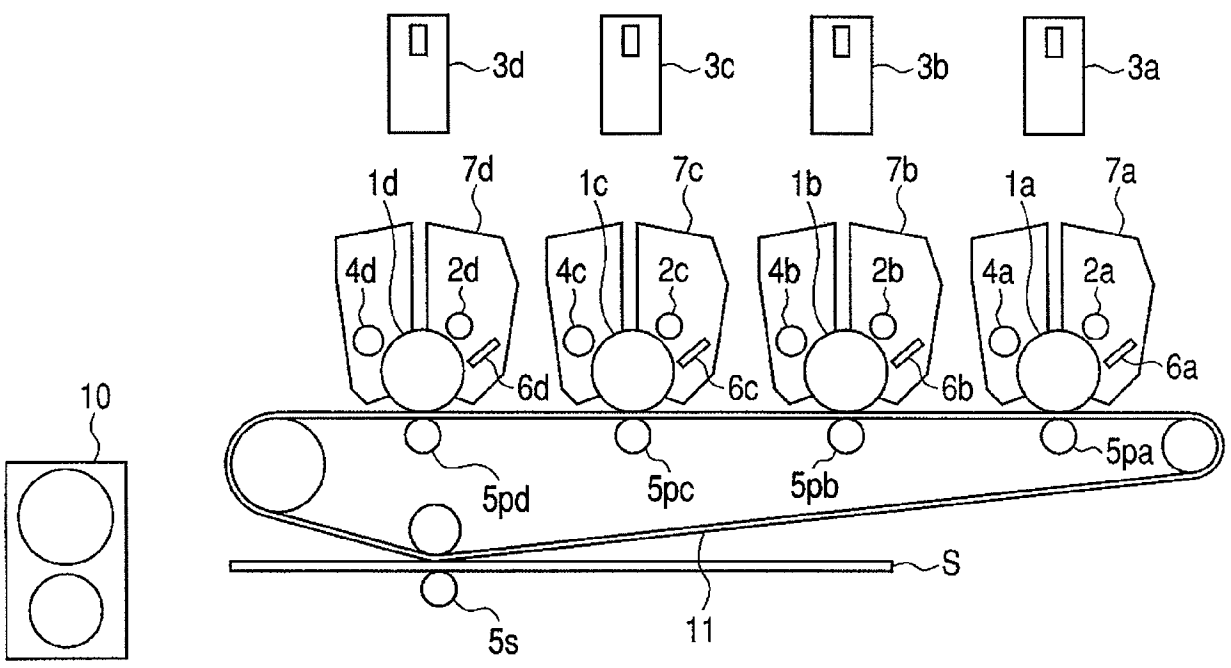
FIG. 2 is an illustration showing a schematic configuration of an image forming apparatus (color image forming apparatus) having an intermediate transfer belt.
Figure 3:
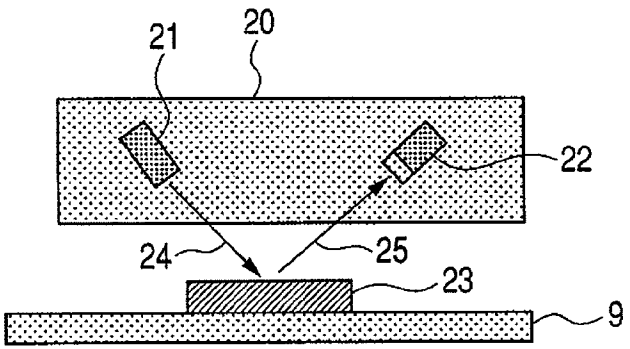
FIG. 3 is an illustration for explaining color shift detecting means.

By setting the endless belt of this example as the transfer material carrying belt of an image forming apparatus having the configuration shown in FIG. 1, color shift detecting ability was confirmed. It was confirmed that the intensity and fluctuation of an output signal from the color shift detecting means were small and a color shift detecting pattern constituted of the toner set on an endless belt was stably detected. In the case of this example, an LED having a light-emitting-center wavelength of 860 nm was used as the light emitting element of color shift detecting means.

Example 2

This example shows an endless belt restraining the fluctuation of the regular reflectance of the surface of the outermost layer of the endless belt by lowering the infrared transmittance of the outermost layer of the endless belt than the case of Example 1.

Inner Layer

An inner layer was formed in the same manner as in Example 1.

Outermost Layer

Ultraviolet-curing acrylic resin (Trade name: DESOLITE Z7501 made by JSR Inc.) was used as the composition for forming an outermost layer. To provide conductivity for the acrylic resin, 30 mass % of isopropyl alcohol sol of zinc antimonate (Trade name: CELNAX made by Nissan Chemical Industries, Ltd.) was added to the acrylic resin. 30 mass % of isopropyl alcohol and 20 mass % of methyl ethyl ketone were mixed to and agitated with the acrylic resin. Moreover, as infrared absorbent, 2.2 mass % of phthalocyanine compound (Trade name: YKR-2080 made by Yamamoto Chemicals, Inc.) and 0.7 mass % of phthalocyanine compound (Trade name: EX-HAL made by Nippon Shokubai Co., Ltd.) were added to the acrylic resin to prepare a solution of the composition for forming an outermost layer. This solution was applied to the outside of the endless tube of the inner layer by using the dip coating method and ultraviolet light was applied to the outside of the endless tube to form an outermost layer having a thickness of 0.9 to 1.1 μm.

The refractive index of the outermost layer was 1.61 and infrared transmittance was 23%.

The average regular reflectance of the surface of the outermost layer of the endless belt of this example was 5.1% and the fluctuation of the regular reflectance was kept within ±5%.

The endless belt of this example was set in as the transfer material carrying belt of an image forming apparatus having the configuration shown in FIG. 1 to confirm color shift detecting ability. It was confirmed that the intensity and fluctuation of an output signal from color shift detecting means were smaller than the case of Example 1, and a color shift detecting pattern constituted of the toner set on the endless belt was stably detected. Also in the case of this example, an LED having a light-emitting central wavelength of 860 nm was used for the light emitting element of the color shift detecting means.

Example 3

This example shows an endless belt in which the average regular reflectance of the surface of the outermost layer of the endless belt is higher than the case of Example 1.

Inner Layer

An inner layer was formed in the same manner as in Example 1.

Outermost Layer

After adding the solution of Example 2 (isopropyl alcohol and methyl ethyl ketone), 30 mass % of methyl ethyl ketone sol of titania compound oxide (Trade name: QUEEN TITANIC made by Catalysts & Chemicals Industries Co., Ltd.) was added to the acrylic resin and agitated. Thereafter, the infrared absorbent used for Example 2 was added to obtain a solution of a composition for forming an outermost layer. This solution was applied to the outside of the endless tube of the above inner layer by using the dip coating method and ultraviolet light was applied to the outside of the endless tube to obtain an outermost layer having a thickness of 0.9 to 1.1 μm.

The refractive index of the outermost layer was 1.78 and the infrared transmittance was 21%.

The average regular reflectance of the surface of the outermost layer of the endless belt of this example was 5.5% and the fluctuation of the regular reflectance was kept within ±7%.

By setting the endless belt of this example as the transfer material carrying belt of an image forming apparatus having the configuration shown in FIG. 1, color shift detecting ability was confirmed. It was confirmed that the intensity of an output signal from the color shift detecting means was further improved than the case of Example 2 and a color shift detecting pattern constituted of the toner set on an endless belt was stably detected.

Example 4

This example shows an endless belt in which an elastomer layer is set at the outside (outer most layer side) of a resin layer (layer of polyvinylidene fluoride) and inside of the outermost layer.

Inner Layer

Polyvinylidene fluoride (Trade name: KF polymer made by Kureha Chemical Industry Co., Ltd.) was used as the composition for forming an inner layer. To provide conductivity for the polyvinylidene fluoride, 8 mass % of acetylene black (Trade name: DENKA BLACK powder made by Denki Kagaku Kogyo K. K.) was added to the polyvinylidene fluoride and 10 mass % of compound containing alkyl quaternary ammonium sulfate ($(C_4H_9)_4NHSO_4$) made by Koei Chemical Co., Ltd.) was added to the polyvinylidene fluoride. These were kneaded by a kneading extruder having a twin screw under nitrogen gas atmosphere to produce pellets of resin composition. The pellets were dried under nitrogen gas atmosphere.

Then, the pellets of resin composition were supplied to a cylindrical extruder to obtain a cylindrical endless tube having a thickness of 100 μm by melt-extruding the pellets.

To provide conductivity for thermoplastic elastomer (Trade name: SANTOPRENE 8211-55 made by AES JAPAN Ltd.), 9.5 mass % of acetylene black (Trade name: DENKA BLACK powder made by Denki Kagaku Kogyo K. K.) was added to the thermoplastic elastomer and kneaded and the obtained composition was extruded like a sheet to obtain a sheet having a thickness of 50 μm.

The sheet of the composition of the thermoplastic elastomer was cylindrically formed at the outside of the above endless tube of polyvinylidene fluoride to use the sheet as the inner layer (laminated-type inner layer) of the endless belt.

To cylindrically form a sheet of the composition of thermoplastic elastomer at the outside of an endless tube of polyvinylidene fluoride, any method may be suitable as long as the step at a seam between sheets does not affect the use of an endless belt for an image forming apparatus and a sufficient strength is secured. To cylindrically form sheet-like plastic, for example, the method of depositing only both ends of a sheet disclosed in Japanese Patent Application Laid-Open No. H07-205274 is used. Moreover, the method of obtaining an endless belt by setting ends of sheet-like plastic at the position where they are generally combined them between cylindrical dies which have different thermal expansion coefficients and heating the whole including a die disclosed in Japanese Patent No. 3441860 may also be included as an example of suitable methods.

In the case of this example, an inner layer was obtained by using the method disclosed in Japanese Patent No. 3441860 and thereby attaching a sheet having the composition of thermoplastic elastomer to the outside of an endless tube made of polyvinylidene fluoride.

The refractive index of the laminated-type inner layer was 1.48.

Outermost Layer

An outermost layer was formed in the same manner as in Example 1.

The average regular reflectance of the surface of the outermost layer of the endless belt of this example was 5.1% and the fluctuation of regular reflectance was kept within ±7%.

By setting the endless belt of this example as the transfer material carrying belt of an image forming apparatus having the configuration shown in FIG. 1, color shift detecting ability was confirmed. It was confirmed that the intensity and fluctuation of an output signal from color shift detecting means were small, and a color shift detecting pattern constituted of the toner set on an endless belt was stably detected.

Comparative Example 1

This comparative example shows an endless belt in which the regular reflectance of the surface of the outermost layer of the endless belt is smaller than the cases of examples.

Inner Layer

An inner layer was formed in the same manner as in Example 1.

Outermost Layer

Ultraviolet-curing acrylic resin (Trade name DESOLITE Z7501 made by JSR Inc.) was used as the composition for forming an outermost layer. To provide conductivity for the ultraviolet-curing acrylic resin, 15 mass % of isopropyl alcohol sol of zinc antimonate (Trade name: CELNAX made by Nissan Chemical Industries, Ltd.) was added to the acrylic resin. 40 mass % of isopropyl alcohol and 10 mass % of methyl ethyl ketone were mixed to and agitated with the acrylic resin. Moreover, as infrared absorbent, 1.7 mass % of phthalocyanine compound (Trade name: YKR-2080 made by Yamamoto Chemicals, Inc.) was added to acrylic resin to obtain a solution of the composition for forming an outermost layer. This solution was applied to the outside of the endless tube of the above inner layer by using the dip coating method and ultraviolet light was applied to the outside of the endless tube to obtain an outermost layer having a thickness of 0.9 to 1.1 μm.

The refractive index of the outermost layer was 1.58 and the infrared transmittance was 40%.

The average regular reflectance of the surface of the outermost layer of the endless belt of this comparative example was 4.9% and the fluctuation of the regular reflectance was kept within ±4%.

As a result of setting the endless belt of this comparative example as the transfer material carrying belt of an image forming apparatus having the configuration shown in FIG. 1 and confirming the color shift detecting ability, the intensity of an output signal of the surface of the endless belt from color shift detecting means was small and it was difficult to stably detect a color shift detecting pattern constituted of the toner set on the endless belt.

Comparative Example 2

This comparative example shows an endless belt having a large fluctuation of the regular reflectance of the surface of the outermost layer of the endless belt.

Inner Layer

An inner layer was formed in the same manner as in Example 1.

Outermost Layer

Ultraviolet-curing acrylic resin (Trade name: DESOLITE Z7501 made by JSR Inc.) was used as the composition for forming an outermost layer. To provide conductivity for the acrylic resin, 30 mass % of isopropyl alcohol sol of zinc antimonate (Trade name: CELNAX made by Nissan Chemical Industries, Ltd.) was added to the acrylic resin. 40 mass % of isopropyl alcohol and 10 mass % of methyl ethyl ketone were added to the acrylic resin and agitated to obtain a solution of the composition for forming an outermost layer. The solution was applied to the outside of the endless tube of the above inner layer by using the dip coating method and ultraviolet light was applied to the outside of the endless tube to obtain an outermost layer having a thickness of 0.9 to 1.1 μm.

The refractive index of the outermost layer was 1.61 and the infrared transmittance was 78%.

The average regular reflectance of the surface of the outermost layer of the endless belt of this comparative example was 5.1% and the fluctuation of the regular reflectance was kept within ±13%.

It is estimated that the magnitude of the fluctuation of the regular reflectance of this comparative example occurs because infrared absorbent is not mixed in the composition for forming an outermost layer, the infrared transmittance of an outermost layer is as large as 78% and the interference on the interface between the outermost layer and the inner layer is not uniform.

As a result of setting the endless belt of this comparative example as the transfer material carrying belt of an image forming apparatus having the configuration shown in FIG. 1 and confirming the color shift detecting ability, the fluctuation of signals output from color shift detecting means was large and it was difficult to stably detect a color shift detecting pattern constituted of the toner set on an endless belt.

Comparative Example 3

This comparative example also shows an endless belt having large fluctuation of the regular reflectance of the surface of the outermost layer of the endless belt.

Inner Layer

An inner layer was formed in the same manner as in Example 1.

Outermost Layer

Ultraviolet-curing acrylic resin (Trade name: DESOLITE Z7501 made by JSR Inc.) was used as the composition for forming an outermost layer. To provide conductivity for the acrylic resin, 15 mass % of isopropyl alcohol sol of zinc antimonate (Trade name: CELNAX made by Nissan Chemical Industries, Ltd.) was added to the acrylic resin. 30 mass % of isopropyl alcohol and 20 mass % of methyl ethyl ketone were added to the acrylic resin and agitated. Thereafter, 53 mass % of methyl ethyl ketone sol of titania compound oxide (Trade name: QUEEN TITANIC made by Catalysts & Chemicals Industries Co., Ltd.) was added to the acrylic resin and agitated. Thereafter, the infrared absorbent used for Example 1 was added to prepare a solution of the composition for forming an outermost layer. This solution was applied to the outside of the endless tube of the above inner layer by using the dip coating method and ultraviolet light was applied to the outside of the endless tube to obtain an outermost layer having a thickness of 0.9 to 1.1 μm.

The refractive index of the outermost layer was 1.81 and the infrared transmittance was 25%.

The average regular reflectance of the surface of the outermost layer of the endless belt of this comparative example was 5.3% and the fluctuation of the regular reflectance was kept within ±12%.

As the refraction index of the outermost layer rises, it became clear that the difference with the refractive index of the inner layer is increased, the interference between the reflected light on the surface of the outermost layer and the reflected light on the interface between the outermost layer and the inner layer is amplified and the fluctuation of the regular reflectance becomes a large value exceeding ±10%.

As a result of setting the endless belt of this comparative example as the transfer material carrying belt of an image forming apparatus having the configuration shown in FIG. 1 and confirming the color shift detecting ability, the fluctuation of output signals from color shift detecting means was large and it was difficult to stably detect a color shift detecting pattern constituted of the toner set on an endless belt.

Table 1 shows the summary of the examples and the comparative examples.

TABLE 1

| | | Example 1 | Example 2 | Example 3 | Example 4 | Comparative Example 1 | Comparative Example 2 | Comparative Example 3 |
|---|---|---|---|---|---|---|---|---|
| Inner layer | Refractive index | 1.41 | 1.41 | 1.41 | 1.48 | 1.41 | 1.41 | 1.41 |
| Outermost layer | Thickness of layer | 0.9-1.1 μm | 0.9-1.1 μm | 0.9-1.1 μm | 0.9-1.1 μm | 0.9-1.1 μm | 0.9-1.1 μm | 0.9-1.1 μm |
| | Refractive index | 1.60 | 1.61 | 1.78 | 1.60 | 1.58 | 1.61 | 1.81 |
| | Infrared transmittance | 38% | 23% | 21% | 38% | 40% | 78% | 25% |
| Endless belt | Average regular reflectance | 5.1% | 5.1% | 5.5% | 5.1% | 4.9% | 5.1% | 5.3% |
| | Fluctuation of regular reflectance | Within ±9% | Within ±5% | Within ±7% | Within ±7% | Within ±4% | Within ±13% | Within ±12% |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-346690, filed Nov. 30, 2005, which is hereby incorporated by reference herein in its entirety.

What is claimed is:

1. An endless belt for an image forming apparatus comprising: at least two layers of an inner layer and an outermost layer, wherein (a) the average regular reflectance of the surface of the outermost layer is 5.0% or more as measured by infrared radiation emitted;

(b) the fluctuation of the regular reflectance of the surface of the outermost layer is kept within ±10% of the average regular reflectance;

(c) the outermost layer contains an infrared absorbent and the refractive index of the outermost layer is higher than that of the inner layer.

2. The endless belt for an image forming apparatus according to claim 1, wherein the refractive index of the outermost layer ranges from 1.60 to 1.80.

3. The endless belt for an image forming apparatus according to claim 1, wherein the outermost layer contains acrylic resin as a binding resin.

4. The endless belt for an image forming apparatus according to claim 1, wherein the inner layer contains thermoplastic resin as a binding resin.

5. An image forming apparatus comprising the endless belt for the image forming apparatus according to claim 1.

6. An endless belt for an image forming apparatus comprising: at least two layers of an inner layer and an outermost layer, wherein (a) the average regular reflectance of the surface of the outermost layer is 5% or more as measured by infrared radiation emitted, (b) the fluctuation of the regular reflectance of the surface of the outermost layer is kept within ±10% of the average regular reflectance; and (c) the infrared transmittance of the outermost layer is 40% or less.

* * * * *